US006229509B1

(12) United States Patent
DeLuca et al.

(10) Patent No.: US 6,229,509 B1
(45) **Date of Patent: *May 8, 2001**

(54) INTERSECTING BEAM DISPLAY PANEL

(76) Inventors: Michael DeLuca; Joan DeLuca, both of 734 Camino Gardens La., Boca Raton, FL (US) 33432

( * ) Notice: Subject to any disclaimer, the term of this patent is extended or adjusted under 35 U.S.C. 154(b) by 0 days.

This patent is subject to a terminal disclaimer.

(21) Appl. No.: 09/338,956

(22) Filed: Jun. 24, 1999

Related U.S. Application Data

(63) Continuation of application No. 08/872,262, filed on Jun. 10, 1997, now Pat. No. 6,031,511.

(51) Int. Cl.[7] ..... G09G 3/34

(52) U.S. Cl. ..... 345/84; 345/55; 359/326

(58) Field of Search ..... 345/55, 84, 65, 345/74, 76; 348/752, 754, 762, 763, 767, 768; 362/84; 359/326

(56) References Cited

U.S. PATENT DOCUMENTS

| | | | |
|---|---|---|---|
| 3,829,838 | | 8/1974 | Lewis et al. . |
| 4,578,709 | | 3/1986 | Lang et al. . |
| 4,766,424 | | 8/1988 | Adler et al. . |
| 4,870,485 | | 9/1989 | Downing et al. . |
| 5,008,890 | | 4/1991 | McFarlane . |
| 5,170,156 | | 12/1992 | Demond et al. . |
| 5,214,419 | | 5/1993 | Demond et al. . |
| 5,245,623 | | 9/1993 | McFarlane . |
| 5,283,563 | | 2/1994 | Allen et al. . |
| 5,381,310 | | 1/1995 | Brotz . |
| 5,684,621 | | 11/1997 | Downing . |
| 5,764,403 | * | 6/1998 | Downing ..... 359/326 |
| 5,914,807 | | 6/1999 | Downing . |

OTHER PUBLICATIONS

J.D. Lewis et al., "A True Three–Dimensional Display," IEEE Trans. Electron. Dev., vol. ED–18, No. 9, Sep. 1971, pp. 724–731.

Downing, E. et al., "A Three–Color, Solid State, Three–Dimensional Display," Science, vol. 273, pp 1185–1189, Aug. 30, 1996.

Downing, E. et al., "A Laser Diode Driven Solid State, Three–Dimensional Display," http://www.stanford.edu/group/CNOM/AnnualReport95/SecD/D.1.pdf, Apr. 18, 1996.

Schewe, P. F., Physics News Update, The American Institute of Physics News, No. 285, Sep. 9, 1996.

Crystal Cube, 3–D Technology Laboratory's Three Dimensional Cube Display, Discover Magazine, Jul., 1997.

Winters, J., Cube Tube, Discover Magazine, Dec., 1996.

* cited by examiner

*Primary Examiner*—Kent Chang
(74) *Attorney, Agent, or Firm*—Ideoco.com

(57) ABSTRACT

A two dimensional display panel produces a time variable image composed of light emitting pixels. The pixels are generated by a light emitting phosphor distributed within the panel, the pixels radiate light in response to being excited by charging and triggering energy beams. The energy beams are relatively invisible and may be generated by lasers or solid state diode energy sources. Wave guides within the panel direct the energy beams to the pixels. The wave guides may be composed of fiber optic threads and the display panel comprised of a fabric of woven fiber optic threads wherein pixels are produced at intersections of the woven fiber optic threads.

19 Claims, 3 Drawing Sheets

INTERSECTING BEAM DISPLAY PANEL

RELATED APPLICATION DATA

This application is a continuation of U.S. application Ser. No. 08/872,262, Jun. 10, 1997, now U.S. Pat. No. 6,031,511.

FIELD OF THE INVENTION

The present invention pertains to a system for producing images, and more particularly, to apparatus for producing two dimensional electronically generated images.

BACKGROUND OF THE INVENTION

Television receivers and other display systems use a cathode ray tube having a fluorescent coating deposited on a slightly curved screen inside the tube. In a black and white tube an electron gun directs a beam of electrons toward the screen with the electron beam being scanned over the surface of the screen by vertical and horizontal deflection systems. A control grid varies the amount of current in the beam to vary the brightness of different areas on the screen. In a color tube a trio of beams are each intensity controlled and each beam is directed toward one of three colors of phosphor on the screen. However, in both black and white and in color television the image can be viewed only from the front of the screen, which is opposite from the side of the screen containing the phosphor. Further, the electron gun requires that a cathode ray tube display system be thick. And still further, the display is constructed of a rigid glass to facilitate direction of the electron beam upon the phosphor.

More recent flat panel displays have significantly reduced the thickness of display systems. Liquid Crystal Display (LCD) systems require individually electrically addressable pixels on the display surface which are switched between transparent and opaque states. The pixels gate light generated typically from an electroluminescence light panel in order to generate the display. Such displays require complex circuitry to activate each pixel, and are visible typically from the side opposite to the electroluminescence panel.

U.S. Pat. No. 4,870,485 to Downing; Elizabeth A., et. al., Sep. 26, 1989, entitled: THREE DIMENSIONAL IMAGE GENERATING APPARATUS HAVING A PHOSPHOR CHAMBER, hereby incorporated by reference, describes a three dimensional image generating apparatus having a three dimensional image inside an image chamber. Such a system has been publicly demonstrated. An imaging phosphor distributed through the image chamber is excited by a pair of intersecting laser beams which cause the phosphor to emit visible light and form an image as the intersecting beams move through the image chamber. The imaging phosphor is a rapidly-discharging, high conversion efficiency, electron trapping type which stores energy from a charging energy beam for a very short time, such as a few microseconds. The imaging phosphor releases photons of visible light when energy from a triggering energy beam reaches phosphor containing energy from the charging beam. This triggering results in radiation of visible light from each point where the charging energy beam crosses the triggering energy beam. A first scanning system directs the charging energy beam to scan through a space in the image chamber and a second scanning system directs the triggering energy beam to scan through space in the image chamber. These two energy beams intersect at a series of points in space to produce a three dimensional image inside the image chamber. The energy beams are provided by a pair of lasers with one beam in the infrared region and the other in the blue, green, or ultraviolet portion of the spectrum. However, an electromechanical mirror based beam steering mechanism makes the display bulky, subject to vibration of the display and the glass cube is rigid.

Thus, what is needed is a thin flexible display panel having multi-color light generating pixels which may be viewed from either side of the panel and requires no moving parts to generate the display.

SUMMARY OF THE INVENTION

A display apparatus comprises a panel having a display surface surrounded by an edge and an imaging phosphor therein. A first source for radiating a first energy beam enters through a first portion of the edge, a second source for radiating a second energy beam enters through a second portion of the edge, and a third source for radiating a third energy beam enters through a third portion of the edge. A first pixel of visible light energy is released by the imaging phosphor at an intersection of the first and third energy beams, and a second pixel of visible light energy is released by the imaging phosphor at an intersection of the second and the third energy beams, the first and second pixels of visible light having a substantially constant location on the display surface.

BRIEF DESCRIPTION OF THE DRAWINGS

FIG. 2 shows a display apparatus having a panel composed of orthogonal layers of parallel wave guides having reflectors at an end and an imaging phosphor layer interposed between.

FIG. 3 shows an intersection of two wave guides of FIG. 2 and the imaging phosphor there between.

DETAILED DESCRIPTION OF THE INVENTION

Figure 1:
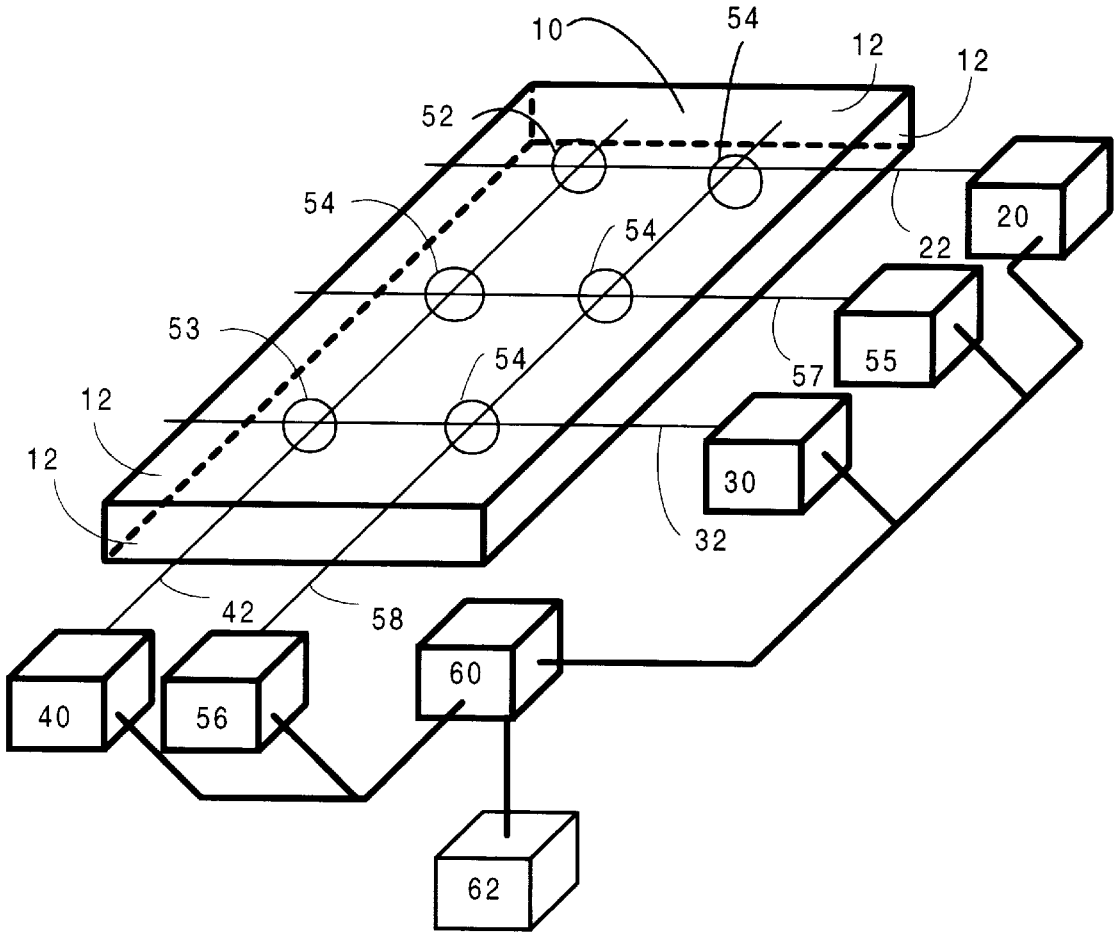
FIG. 1 shows a display apparatus having a display panel excited by sources radiating energy beams.

FIG. 1 shows a display apparatus having a display panel excited by sources radiating energy beams. The display panel 10 has an edge 12 surrounding it on all sides. The display panel is preferably substantially transparent to visible light and has imaging phosphor distributed therein. A first source 20 radiates a first energy beam 22 into a first portion of edge 12. A second source 30, preferably having a wavelength substantially similar to that of source 20, emits a second energy beam 32 into a second portion of edge 12. A third source 40, preferably having a different wavelength from sources 20 and 30, radiates a third energy beam 42 into a third portion of edge 12.

Sources 20 and 30 may represent either triggering or charging energy beams and source 40 may represent either a charging or triggering energy beam respectively, such that the imaging phosphor releases visible light energy when energy from a triggering energy beam reaches phosphor containing energy from a charging energy beam.

A first pixel of visible light energy 52 is released by the imaging phosphor at intersection of the first energy beam 22 and the third energy beam 42, and a second pixel of visible light energy 53 is released by the imaging phosphor at intersection of the second energy beam 32 and the third energy beam 42. The first and second pixels of visible light have a substantially constant location on the display surface of panel 10. Numerous additional pixels 54 may be added by adding additional sources including sources 55 and 56. Sources 20, 30, 40, 55 and 56 may be realized by lasers or solid state diodes emitting energy beams at appropriate charging and triggering wavelengths.

A switching means 60 is coupled to at least the first, second and third sources, 20, 30 and 40. The switching means is responsive to a display generator 62 which generates a display signal for selectively activating at least the first and second pixels, 52 and 53. Display generator 62 may be any of numerous display generators known in the art including either a television receiver or a personal computer. The switching means 60 enables the first and third energy beams 22 and 42 in response to the display signal indicating activation of the first pixel 52, and enables the second and third energy beams 32 and 42 in response to the display signal indicating activation of the second pixel 53. The switching means 60 enables the first, second and third energy beams, 22, 32 and 42 in response to the display signal indicating activation of the first and second pixels 52 and 53. Activation of a energy beam may be either by providing energizing power to its respective source, or a switching a shutter at the output of the respective source. Numerous additional pixels 54 may be selectively activated by coupling switching means 60 to additional sources, such as sources 55 and 56 and enabling the respective energy beams in a corresponding way.

The display apparatus of FIG. 1 has an advantage in that the alignment of panel 10 relative to sources 20, 30, 40, 55 and 56 is not critical so long as the corresponding energy beams are radiated within panel 10. The pixel location is defined by the intersection of the energy beams within the panel, not necessarily the alignment of the panel relative to the sources. This has the advantage of reducing precision manufacturing of the display apparatus. Further, panel 10 can be a relatively thin layer of glass or flexible plastic, and since no electrical wiring connection is necessary within the panel to activate pixels, the cost of the panel may be significantly reduced. Since the pixel density and display size is determined by the number and placement of the sources, and since the sources may be made from low cost high density solid state diodes, a large size, high pixel density flat panel display can be made. Since each pixel radiates light out of either surface of the panel, a display produced by the display apparatus may be viewed from either side of the panel.

Figure 2:
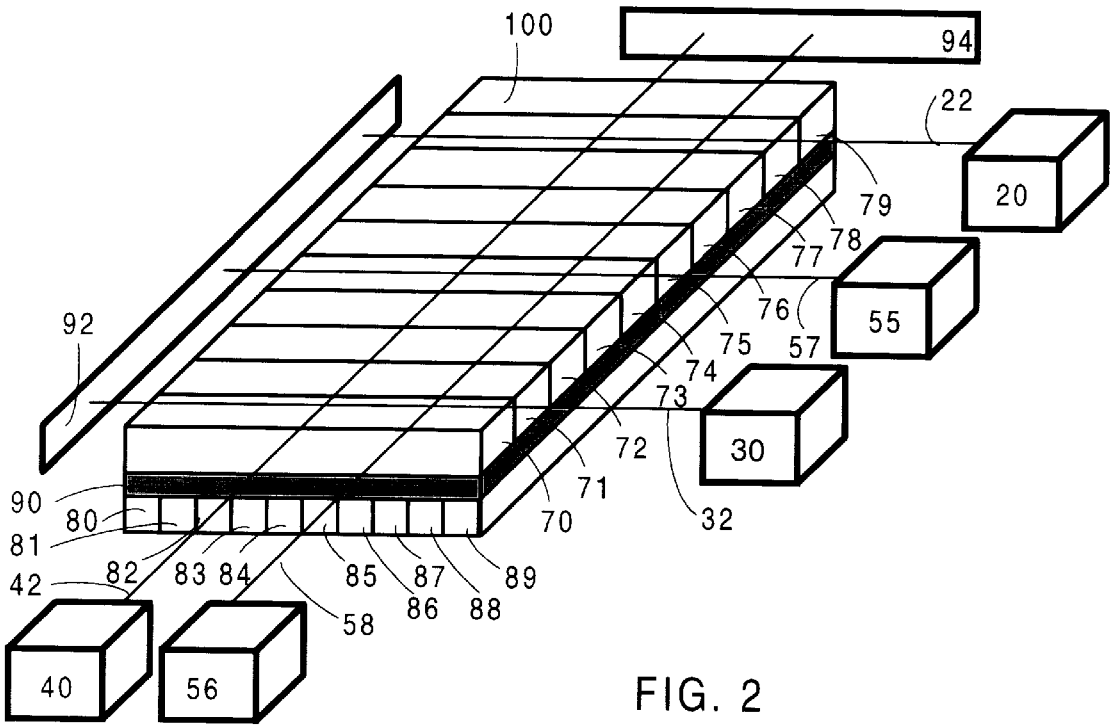

FIG. 2 shows a display apparatus having a panel composed of orthogonal layers of parallel wave guides having reflectors at an end and an imaging phosphor layer interposed between. Panel 100 comprises a first layer having a first multiplicity of substantially parallel wave guides 70–79, for channeling energy beams 22, 32 and 57, and a second layer having a second multiplicity of substantially parallel wave guides for channeling energy beams 42 and 58. The wave guides limit dispersion of the energy beams within the layer with a smooth internally reflective surface which enables internal reflection of energy beams thereby also limiting dispersion and intersection of energy beams within the layer. The layers of FIG. 2 may be comprised of numerous laminated fiber optic pipes. An imaging phosphor layer 90 interposed between the first layer 70–79 and second layer 80–88 has the imaging phosphor distributed there through. Sources 20, 30 and 55 are coupled to apertures at one end of the wave guides of the first layer 70–79 and reflector 92 is coupled to apertures at the other end of the wave guides 70–79. Sources 40 and 56 are coupled to apertures at one end of the wave guides 80–88 of the second layer and a reflector 94 is coupled to apertures at the other end. While the sources 20, 30, 40, 55 and 57 and reflectors 92 and 94 are shown a distance from their respective layers for illustrative purposes, they are preferably attached to apertures at the end of the wave guides of the perspective layers.

In FIG. 2, source 20 radiates and energy beam 22 substantially into wave guide 78, source 30 radiates energy beam 32 substantially into wave guide 71, source 40 radiates energy beam 42 substantially into wave guide 82, source 55 radiates energy beam 57 substantially into wave guide 75, and source 56 radiates energy beam 58 substantially into wave guide 85. The panel of FIG.2 maintains the advantage that the alignment of the sources with the panel is not critical because a pixel of light is formed at an intersection of the energy beams. For example, energy beam 32 could be conducted not only by wave guide 71, but by adjacent wave guides 70 or 72 without interference from adjacent energy beam 57 and while further maintaining substantially constant pixel location on the surface of panel 100. The panel of FIG. 2 has the further advantage in that if the energy beams have a tendency to disperse or spread out as they travel further from the source, the wave guide will tend to limit the dispersion to within itself. Thus, a pixel generated farther from the source, will have substantially the same size as a pixel generated close to the source because the size is substantially determined by the dimensions of the wave guide rather than the dispersion characteristics of the charging and triggering energy beams.

The panel of FIG. 2 has a further advantage in that the reflector at the end of the wave guide tends to compensate for any attenuation of the energy beam by the wave guide.

The sum of the power of energy beam originated from the source plus the power of the energy beam reflected by the reflector should result in a more constant distribution of power through the wave guide. This will help assure a more even brightness of pixels across the panel.

Another advantage of the panel of FIG. 2 is that the parallel nature of the wave guides reduces the requirement of parallel alignment of energy beams generated by the sources of one layer relative to each other, for example the parallel alignment of energy beams 22, 32 and 57 relative to each other, and energy beams 42 and 58 relative to each other necessary to produce evenly spaced pixels is reduced because the wave guides tend to assure the parallel nature of the energy beams even though the respective sources may not accurately generate parallel energy beams. Furthermore, the orthogonal alignment of energy beams of the two layers is reduced, for example the intersection of wave guides 70–79 with wave guides 80–88 assure an evenly space matrix of pixels without a critical orthogonal alignment of energy beams 22, 32 and 57 with energy beams 42 and 58. This should significantly reduce precision manufacturing of the invention. Further, wave guides 70–79 and 80–88 may be made of an identical laminated optic material and rotated 90 degrees at the time of assembly.

Figure 3:
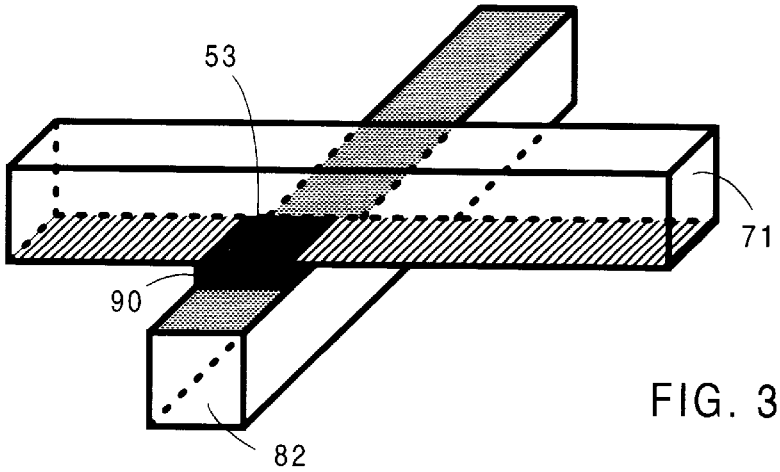

FIG. 3 shows an intersection of two wave guides of FIG. 2 and the imaging phosphor there between. Wave guide 71, which conducts energy beam 32 intersects with wave guide 82 which conducts energy beam 42. Wave guides 71 and 82 may be representative of all wave guides of FIG. 2. Wave guides 71 and 82 are shown to have hash marks on one surface indicating that surface is etched or made unsmooth to facilitate the energy beam of the wave guide to intersect with energy beams of wave guides of other layers. The remaining surface of the wave guide is smooth to facilitate internal reflection of an energy beam within the wave guide. As energy beam 32 it transmitted through the etched surface of wave guide 71, it intersect with portions of energy beam 42 transmitted through the etched surface of wave guide 82. At intersection 53 of both wave guides, the imaging phosphor layer 90 receives radiation from both charging and triggering energy beams and thus illuminates visible light.

This produces a pixel having a well defined location on the surface of panel 100 of FIG. 2 due to the orthogonal relationship of the wave guides.

In alternate embodiments, the phosphor of the imaging phosphor layer could be incorporated into either or both the wave guides layers, thereby eliminating the need for a separate imaging phosphor layer. Furthermore color displays may be made by stacking multiple panels 100 and their associated energy beam sources, each panel capable of generating a different color of light. For example three panels, having red, blue and green pixels respectively, would produce colors commonly used in television and personal computer applications.

Alternately, individual wave guides could cause generation of pixels of various colors: a first compound would be distributed within one wave guide for generating a first pixel with a first color of visible light energy and a second compound distributed within another wave guide for generating the second pixel with a second color of visible light energy. For example, each wave guide could have a compound to filter light color generated by the imaging phosphor layer. For example, wave guide 78 could be tinted to allow red light to pass, while wave guide 74 could be tinted to allow green light to pass and wave guide 71 could be tinted to allow blue light to pass. In such a case, the intervening wave guides 70, 72, 73, 75, 76, 77 and 79 could be eliminated, combined or made redundant to an appropriate adjacent wave guide. In another example, imaging phosphor compounds could be made to generate predominantly one color of light and then dispersed through a wave guide. For example, a red imaging phosphor could be distributed in wave guide 78, a green imaging phosphor distributed in wave guide 74 and a blue imaging phosphor distributed in wave guide 71, this allows both the generation of color pixels and the illumination of imaging phosphor layer 90. Finally the energy beams themselves could be modified to make a common phosphor generate various colors of light pixels. Thus, red, green and blue pixels may be generated, allowing the display panel to generate color displays. The intensity of each pixel may be varied by varying the intensity of either the charging or triggering energy beam, or both.

Figure 4:
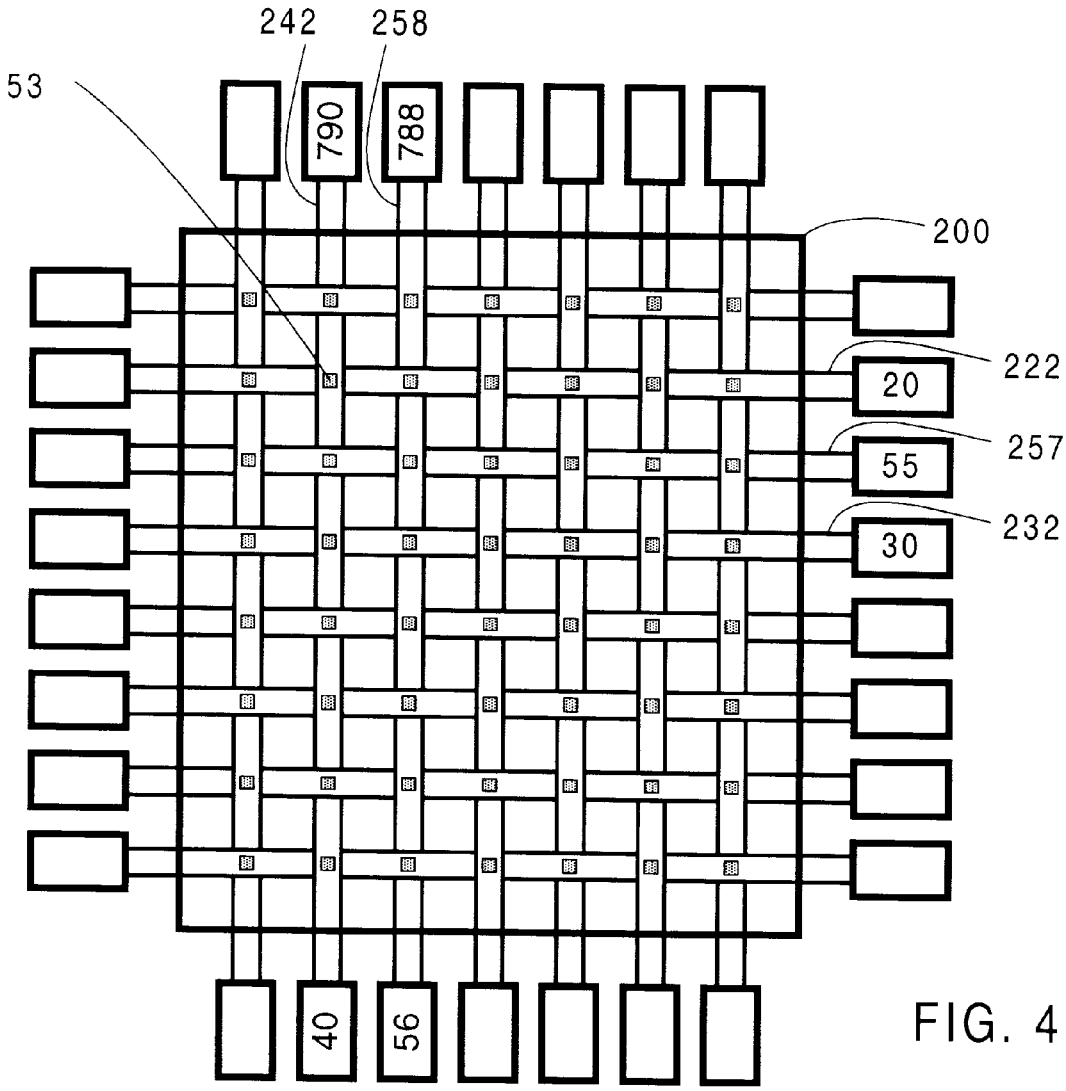
FIG. 4 shows a panel of display fabric having a plurality of parallel fiber optic threads woven orthogonal to another plurality of parallel fiber optic threads, wherein pixels of light are generated by imaging phosphor at intersections of the threads.

FIG. 4 shows a panel of display fabric having a plurality of parallel fiber optic threads woven orthogonal to another plurality of parallel fiber optic threads, wherein pixels of light are generated by imaging phosphor at intersections of the threads. Display panel 200 is comprised of a multiplicity of substantially parallel fiber optic wave guides, including 222, 232 and 257, orientated orthogonal to a second multiplicity of substantially parallel fiber optic wave guides, including 242 and 258. Light generating pixels occur at intersections of the fiber optic threads, such as pixel 53, resulting from a light emitting phosphor being charged and triggered by energy beam sources 20 and 40 as previously described.

Figure 5:
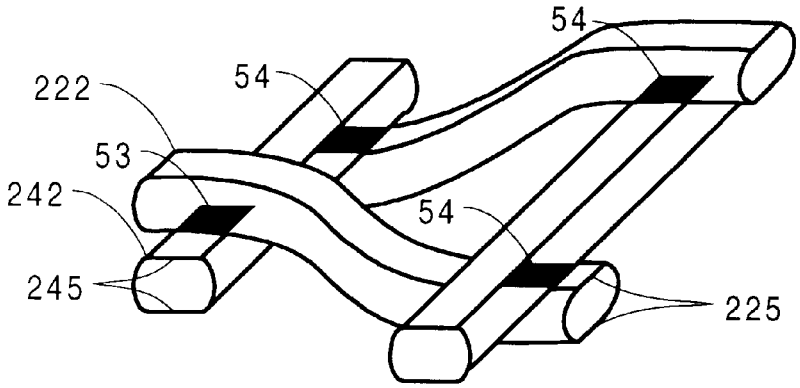
FIG. 5 shows a perspective view of the display fabric panel of FIG. 4.

FIG. 5 shows a perspective view of the display fabric panel of FIG. 4. Pixel 53 is generated by and intersection of energy beams of fiber optic wave guides 242 and 222. Wave guide fiber optic thread 242 has a surface 245 for facilitating intersection of its energy beam with energy beams of orthogonal wave guides such as fiber optic wave guide 222. The remaining surface of fiber optic thread 242 facilitates energy beam internal reflection. Similarly, wave guide fiber optic thread 222 has a surface 225 for facilitating intersection of its energy beam with energy beams of orthogonal wave guides such as fiber optic wave guide 240. The remaining surface of fiber optic thread 240 facilitates energy beam internal reflection Surfaces 245 and 225 may be etched or non-smooth to facilitate energy the intersection of energy beams at pixels 53 and 54. Light emitted from pixels may be generated by illuminating phosphor deposited at the intersection of threads 222 and 242. Alternately either or both fiber optic wave guide threads 222 and 242 may have illuminating phosphor distributed there through. The intersection forming pixels 53 and 54 may be made by a friction fit due to the weaving of flexible fiber optic threads or by fusing the fiber optic threads together at the pixel intersections. Alternately, if a fusing technique is used, a round fiber optic thread may be used, as the fuse between the threads will facilitate the intersection of energy beams of the threads to produce a pixel.

Referring back to FIG. 4, display panel 200 may generate color images by adding compounds to wave guide threads. For example, as previously described, a phosphor radiating a predominant red, green and blue color could be added to wave guide fiber optic threads 222, 257 and 232 respectively. Alternately the wave guides could be tinted, or the corresponding energy beam sources could be modified to modulate the color of a pixel. Furthermore, reflectors could be added an end of each wave guide thread to compensate for energy beam attenuation as previously described.

The panel of FIG. 4 has the advantage of being composed of thin flexible fiber optic threads, and thus as a panel, it is thin and flexible similar to a cloth. Since fiber optic threads are thin, the pixel density of the panel may be relatively high. And as previously described, panel 200 may produce color images. Pixels of panel 200 can radiate light from both sides of the panel. Further, as previously described, energy beam sources 20, 30, 40, 55 and 56 may be solid state diodes, consequently no moving parts are needed to produce an image on panel 200.

Although the wave guides of FIGS. 2, 3, 4 and 5 show a perpendicular orientation between wave guides to form intersections defining pixels, the orthogonal relationship of the wave guides of the contemplated invention is not limited to a perpendicular configuration. The orthogonal relationship of the wave guides include any non-parallel relationship or a relationship between the wave guides which form an intersection such that illuminating phosphor may be radiated by charging and triggering energy beams.

Thus what is provided is a thin flexible display panel having multi-color light generating pixels which may be viewed from either side of the panel and requires no moving parts to generate the display.

We claim:

1. A display apparatus comprising:

a panel having a display surface surrounded by an edge, said panel further having an illuminating material for generating visible light in response to excitation by two substantially invisible energy beams of different wavelengths therein:

a first source for radiating a first energy beam through a first portion of the edge;

a second source for radiating a second energy beam through a second portion of the edge simultaneous with the first energy beam;

a third source for radiating a third energy beam through a third portion of the edge;

wherein a first pixel of visible light energy is released by the illuminating material at an intersection of the first and third energy beams, and a second pixel of visible light energy is released by the illuminating material at an intersection of the second and the third energy beams, the first and second pixels of visible light having a substantially constant location on the display surface and radiating light at a substantially equivalent wavelength wherein said panel further comprises:

a first individual wave guide for conducting the first energy beam; and a second individual wave guide for conducting the second energy beam.

2. The apparatus of claim 1 wherein:

the illuminating material is an imaging phosphor and the first, second and third energy beams are substantially invisible, and wherein either the first and second energy beams charge and the third energy beam triggers the imaging phosphor of the first and second pixels respectively to release visible light energy, or the third energy beam charges and the first and second energy beams trigger the imaging phosphor of the first and second pixels respectively to release visible light energy.

3. The apparatus of claim 1 further comprising a switching means coupled to said first, second and third sources and responsive to a display signal for selectively activating the first and second pixels, wherein said switching means enables the first and third energy beams in response to the display signal indicating activation of the first pixel, said switching means enables the second and third energy beams in response to the display signal indicating activation of the second pixel, and said switching means enables the first, second and third energy beams in response to the display signal indicating activation of the first and second pixels.

4. The apparatus of claim 1 wherein the illuminating material further comprises:

a first compound distributed within said first individual wave guide for generating the first pixel with a first color of visible light energy; and a second compound distributed within said second individual wave guide for generating the second pixel with a second color of visible light energy.

5. The apparatus of claim 1 wherein said first and second wave guides substantially inhibit intersection of the first and second energy beams and said panel further comprises:

a third wave guide for conducting the third energy beam and for facilitating intersection of the first and third energy beams to produce the first pixel and for facilitating intersection of the second and third energy beams to produce the second pixel.

6. The apparatus of claim 1 wherein said panel further comprises:

a multiplicity of substantially nonintersecting first wave guides including said first individual wave guide and said second individual wave guide; and a multiplicity of substantially nonintersecting second wave guides coupled to and positioned relatively orthogonal to said first wave guides, wherein said first and second sources are coupled to said first wave guides, the first energy beam being substantially included within at least one of said first wave guides and the second energy beam being substantially included within at least another of said first wave guides, and said third source is coupled to said second wave guides wherein the third energy beam is substantially included within at least one of said second wave guides, and further wherein said first wave guides are adapted to limit dispersion of energy beams there between and facilitate intersection of energy beams of said first wave guides with energy beams of said second wave guides, and said second wave guides are adapted to limit dispersion of energy beams there between and facilitate intersection of energy beams of said second wave guides with energy beams of said first wave guides.

7. The apparatus of claim 6 wherein, said first wave guides are comprised within a first layer, and said second wave guides are comprised within a second layer, and said panel further comprises:

an illuminating material layer interposed between said first and second layers, said illuminating material layer having the illuminating material distributed there through.

8. A display panel comprising:

a multiplicity of substantially nonintersecting first wave guides for channeling first radiated energy beams;

a multiplicity of substantially nonintersecting second wave guides for channeling second radiated energy beams, said second wave guides coupled to and positioned relatively orthogonal to said first wave guides; and an illuminating material for generating visible light in response to radiation by the first and second radiated energy beams, wherein said first wave guides are adapted to facilitate intersection of energy beams of said first wave guides with energy beams of said second wave guides, and said second wave guides are adapted to facilitate intersection of energy beams of said second wave guides with energy beams of said first wave guides.

9. The panel of claim 8 wherein, said first wave guides are comprised within a first layer, and said second wave guides are comprised within a second layer, and said illuminating material is comprised within an imaging layer interposed between said first and second layers, said imaging layer having said illuminating material distributed there through.

10. The panel of claim 8 wherein at least one of said first wave guides has a receiving edge for receiving a radiated energy beam and an end edge opposed to the receiving edge, and the panel further comprises a reflector coupled to the end edge for reflecting the energy beam back towards the receiving edge.

11. The panel of claim 8 wherein said first wave guides include a plurality of first fiber optic threads, and said second wave guides include a plurality of second fiber optic threads, wherein said second wave guides are coupled to said first wave guides by weaving the first fiber optic threads with the second fiber optic threads.

12. The panel of claim 11 wherein each of the first fiber optic threads includes said illuminating material therein.

13. The panel of claim 12 wherein said illuminating material of a first fiber optic thread of the first fiber optic threads has a first illuminating material for generating a first color of light in response to be radiated by an energy beam of said first wave guides and an energy beam of said second wave guides, and said illuminating material of a second fiber optic thread of the first fiber optic threads has a second illuminating material for generating a second color of light in response to be radiated by an energy beam of said first wave guides and an energy beam of said second wave guides.

14. A display panel comprising:

a multiplicity of substantially nonintersecting first wave guides for conducting at least a first substantially invisible energy beam; and an optically variable material for modifying a visible light characteristic in response to intersections of at least the first energy beam conducted by the first wave guides and at least a second substantially invisible energy beam.

15. The display panel according to claim 14 wherein said optically variable material includes an illuminating material for generating visible light in response to excitation by the first and second substantially invisible energy beams.

16. The display panel according to claim 14 said optically variable material is comprised within each of said multiplicity of first wave guides.

17. The display panel according to claim 14 wherein said optically variable material uniquely modifies the visible light characteristic at the intersections of the second energy beam and each energy beam of each of the multiplicity of first wave guides.

18. The display panel according to claim 14 further comprising a multiplicity of substantially nonintersecting second wave guides for conducting at least the second energy beam, wherein said first wave guides are adapted to facilitate intersection of energy beams conducted by said first wave guides with energy beams conducted by said second wave guides.

19. The display panel according to claim 18 wherein said optically variable material uniquely modifies the visible light characteristic at the intersections of energy beams conducted by each of the multiplicity of first wave guides and energy beams conducted by each of the multiplicity of second wave guides.

* * * * *